US005135037A

United States Patent [19]

Wijesinghe

[11] Patent Number: 5,135,037

[45] Date of Patent: Aug. 4, 1992

[54] END-DOGGING LOG CARRIAGE

[76] Inventor: Ralph Wijesinghe, 4688 Sunland Pl., Burnaby, British Columbia, Canada, V5J 3A4

[21] Appl. No.: 668,111

[22] Filed: Mar. 12, 1991

[51] Int. Cl.[5] ..... B27B 1/00; B27B 29/02; B27B 7/00

[52] U.S. Cl. ..... 144/357; 83/367; 83/708; 144/242 R; 144/209 A; 144/378

[58] Field of Search ..... 144/208 G, 209 A, 242 R, 144/245 R, 376, 377, 378, 356, 357; 83/707, 708, 712, 365, 360, 367

[56] References Cited

U.S. PATENT DOCUMENTS

| | | | |
|---|---|---|---|
| 2,741,278 | 4/1956 | McMurtie | 83/708 |
| 3,747,455 | 7/1973 | Hartzell | 83/403.1 |
| 3,786,712 | 1/1974 | Mackin | 83/708 |
| 4,068,695 | 1/1978 | Seaman | 144/242 R |
| 4,074,601 | 2/1978 | Warren | 83/425.2 |
| 4,245,535 | 1/1981 | Lockwood | 83/798 |
| 4,489,635 | 12/1984 | Cooper | 83/708 |

*Primary Examiner*—W. Donald Bray
*Attorney, Agent, or Firm*—Norman M. Cameron

[57] ABSTRACT

An end-dogging log carriage including a first dog assembly with a first dog member rotatably mounted thereon and a second dog assembly with a second dog member rotatably mounted thereon. A log is supported solely by the first and second dog members engaging opposite ends of the log. At least one of the dog members is movable horizontally and vertically to orient the log to a desired position for sawing the log. There may be an indexing device operatively connected to one of the dog members through a clutch. The log may be rotated for scanning when the clutch is disengaged. The indexing device and the clutch are engaged after the log is oriented in a rotational position for a first sawing operation. The clutch is left engaged and the indexing device is employed to rotate the log through the required angle for the next sawing operation.

19 Claims, 5 Drawing Sheets

END-DOGGING LOG CARRIAGE

BACKGROUND OF THE INVENTION

1. Field of the Invention

This invention relates to a log carriage for supporting logs during scanning and sawing thereof.

2. Description of the Prior Art

Log carriages are used to secure logs in a desired orientation and move them generally parallel to their longitudinal axes during the sawing operation. The carriages typically have wheels or rollers which ride on guide rails extending generally parallel to the log. The logs are held on the carriage by pointed projections known as "dogs". In the past, the dogs have usually engaged the sides of the log.

After a section of the log has been sawn, it is usually desirable to rotate it ninety degrees or one hundred and eighty degrees from the sawn face and then continue to saw. The dogs are first removed from the log. The log is then rotated the desired amount and the dogs engage the log again to hold it in a second fixed position.

Using log carriages of this type has several disadvantages. First, the log cannot be spin-scanned to determine its profile and cannot be x-ray scanned for internal defects. Second, the sharp dogs damage the outside surface of the log where the best lumber is found. This is especially important for large diameter logs where the outside is the most valuable part. Also, in some cases such carriages induce bending of the log which results in distorted boards when they are sawn from the log.

Because of these disadvantages, end-dogging log carriages were developed where the log is held by opposing dogs which engage the ends of the log only. However, there have been certain disadvantages or limitations with respect to the type of end-dogging carriages developed in the past. For example, in some prior art devices the log is held in position for sawing by an hydraulic brake. After sawing is completed at this position, the log is rotated ninety degrees and the brake is engaged again. However, this rotation cannot be accomplished with extreme accuracy in some prior art end-dogging log carriages because of mechanical backlash in the components of the carriage for example. Such systems are often not accurate even if such accuracy is claimed. For example, lock valves used on hydraulic systems often leak. Even the loss of two or three drops of hydraulic fluid can change the postion of a cylinder. Also reed switchs are not accurate because of mechanical backlash in chains or sprockets for example.

Another problem is that some prior art end-doggers do not support the logs fully by means of the end-dogs. For example, rolls or cylinders may be used to support the log between the end-dogs. Supporting the logs in this manner makes it more difficult to manipulate the log and hold it at a desired orientation for the sawing operation.

Scanning of logs prior to sawing is a common procedure to maximize yield. The scan of the log determines the best way of cutting the log to get the greatest yield, particularly of the more valuable cuts of timber. In many types of log carriages, including end-dogging log carriages, the log is released after the scanning operation is performed. It is reengaged by the dogs prior to the sawing operation. The log may also be released from the dogs between successive sawing positions of the log. This means that the point of reference is lost each time the log is released. Thus such log carriages are not well adapted to automated scanning and sawing of the log, because the logs do not maintain any fixed orientation with respect to any component of the carriage which could provide a fixed reference for scanning and handling.

SUMMARY OF THE INVENTION

One aspect of the invention provides an end-dogging log carriage, comprising a carriage frame and a first dog assembly mounted on the carriage frame. The first dog assembly includes a first dog support and a first log end engaging dog member rotatably mounted on the first dog support. There is also a second dog assembly mounted on the carriage frame. The second dog assembly has a second dog support and a second log end engaging dog member rotatably mounted on the second dog support. The second dog member generally faces the first dog member and is spaced-apart therefrom. There is a motor operatively connected to one of the dog members for rotating the dog members and logs held between the dog members. There is an indexing device which includes a rotatable member and a latching device which is releasably engagable with the rotatable member at one of a plurality of preset positions. A clutch releasably and operatively engages the indexing device to one of the dog members. The dog members and logs held between the dog members are non-rotatable when the clutch and the latching device are engaged. The dog members and logs held between the dog members are rotatable when the clutch is released. The dog members and logs held between the dog members are selectively rotatable to a plurality of fixed angular positions when the clutch is engaged and the latching device engages the rotatable member at different preset positions.

Another aspect of the invention provides a combination of a log, a saw, a guide track near the saw running parallel to the saw blade, and an end-dogging log carriage. The log carriage is movably mounted on the guide track for movement therealong. The carriage includes a carriage frame and a first dog assembly mounted on the frame having a first dog support and a first log end engaging dog member rotatably mounted on the first dog support. There is also a second dog assembly mounted on the frame having a second dog support and a second log end engaging dog member rotatably mounted on the second dog support. The log is between the dog members and is solely supported by the first and second dog members engaging opposite ends of the log. The carriage includes means for moving a least one of the dog members perpendicular to the longitudinal axis of the log to orient the log to a desired position for sawing the log as the carriage moves along the guide track.

The dog members may also be movable in a vertical direction. At least one of the dogs may also be movable horizontally in a direction generally parallel to the longitudinal axis of the log.

A third aspect of the invention provides a method of handling a log for scanning and sawing thereof. First the ends of the logs are pierced with opposing end-dog members. Any intermediate supports between the ends of the log are removed. The dog members are aligned with the longitudinal axis of the log. The log is then rotated. At least one of the dog members is moved perpendiclar to the longitudinal axis of the log to orient the log in a desired sawing orientation. One of the dog members may be connected to an indexing device. The indexing device is engaged in a first position so that the log is held non-rotatably between the dog members at a first angular position about its longitudinal axis. The log is then sawn. The indexing device is then engaged in a second position so the log is held non-rotatably between the dog members at a second angular position about its axis. The log is then sawn again.

The different aspects of the invention described above provide distinct advantages over the prior art including prior art end-dogging log carriages. Because the log can be supported solely by opposing end-dog members, the end-dog members maintain a fixed rotational position with respect to the log. Therefore, if the log is scanned while secured between the end-dog members, they provide a certain reference to reorient the log for successive sawing operations. The invention is thus well adapted for automated scanning and sawing.

In addition, by providing the type of indexing device described, the log can be accurately positioned and repositioned for successive sawing operations without introducing errors as found in the prior art. Having the indexing device connected to the dog members by means of a clutch allows the indexing device to be disengaged, for example, to scan the log. The log can then be oriented to its initial sawing position employing the motor which drives the end-dog members. Once this position is achieved, the indexing device can be engaged with the clutch. The next sawing position can then be accurately found by leaving the clutch engaged and releasing only the indexing device to move to the next angular position, normally ninety or one hundred and eighty degrees from the initial position.

Supporting the logs only by the end-dog members, and providing for vertical and horizontal movement of the end-dog members also provides an easy means for aligning the longitudinal axis of the log for each sawing operation. The data obtained from the scan of the log can be used to position one or both end-dog members horizontally and vertically in order to maximize yield for each sawing operation.

DESCRIPTION OF THE PREFERRED EMBODIMENTS

Figure 1:
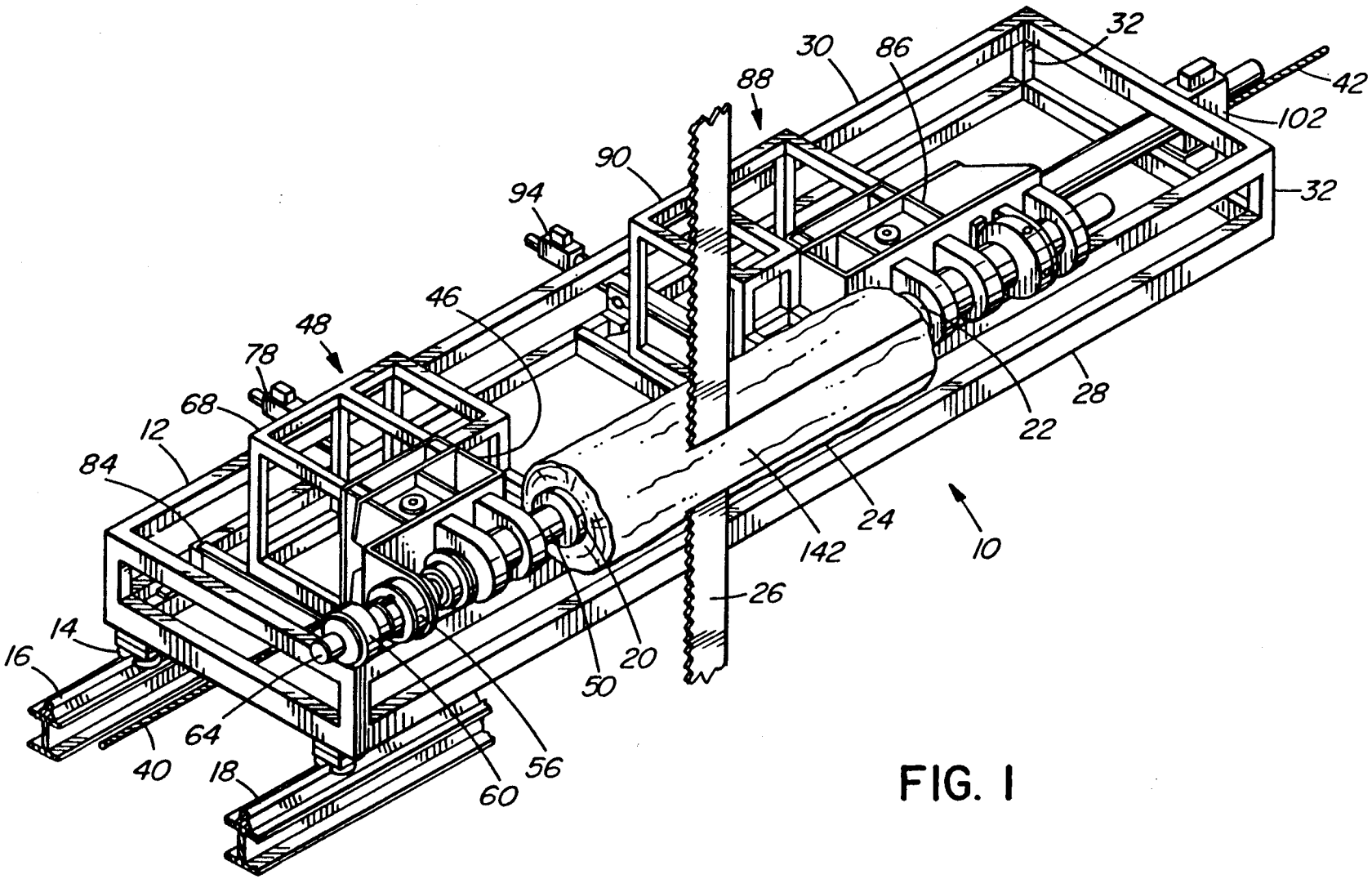
FIG. 1 is a top, front isometric view of an end-dogging log carriage according to an embodiment of the invention, a fragment of its guide track, a fragment of the associated band saw and a log secured between the end-dogs thereof in the process of being sawn by the saw.

First, by way of a brief summary with reference to FIG. 1, an end-dogging log carriage is shown generally at 10. The carriage has a carriage frame 12 supported by a plurality of rollers 14 on a pair of spaced-apart guide tracks 16 and 18. There is a first end-dog member 20 and a second end-dog member 22 rotatably mounted on the carriage. They are shown supporting a log 24 therebetween. Here the carriage is being used to support the log in the proper orientation for band saw 26 to perform the sawing operation when the log is moved. The sawing operation is performed by moving the carriage back and forth along guide tracks 16 and 18.

Figure 2:
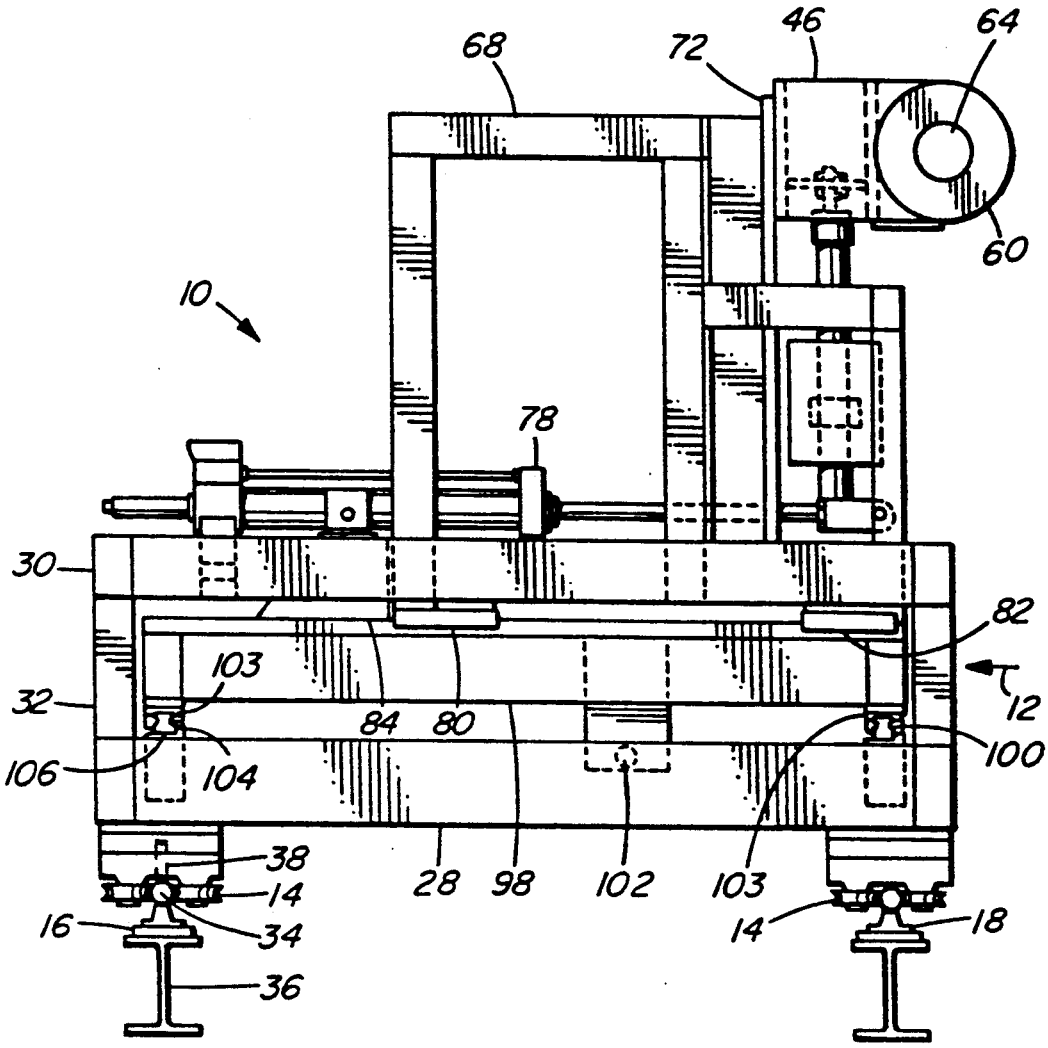
FIG. 2 is an end view of the end-dogging log carriage and guide track from FIG. 1.

As seen in FIG. 1 and 2, frame 12 includes a lower platform 28 and an upper perimeter portion 30 connected together by four uprights 32 in this embodiment. Other configurations could be employed as well. Structural steel members are used throughout in this example.

As seen in FIG. 2, each of the guide tracks 16 and 18 has an elongated, cylindrical member 34 which rests upon an H beam 36 in this particular embodiment as shown for track 16. Track 18 is identical. It may be seen that there is a pair of rollers 14, one on each side of the cylindrical members 34, to provide lateral support for the carriage. There is a roller 38 in this embodiment near each corner of the carriage which rests upon one of the members 34 to provide upward support for the carriage. Other means for supporting and guiding movement of the carriage could be employed alteratively such as flanged wheels and conventional rails or wheels that run on a V rail. Movement of the carriage along the guide tracks is controlled by cables 40 and 42 which are connected to the carriage and extend to winding drums of a log carriage drive (not shown and not part of the invention).

Figure 4:
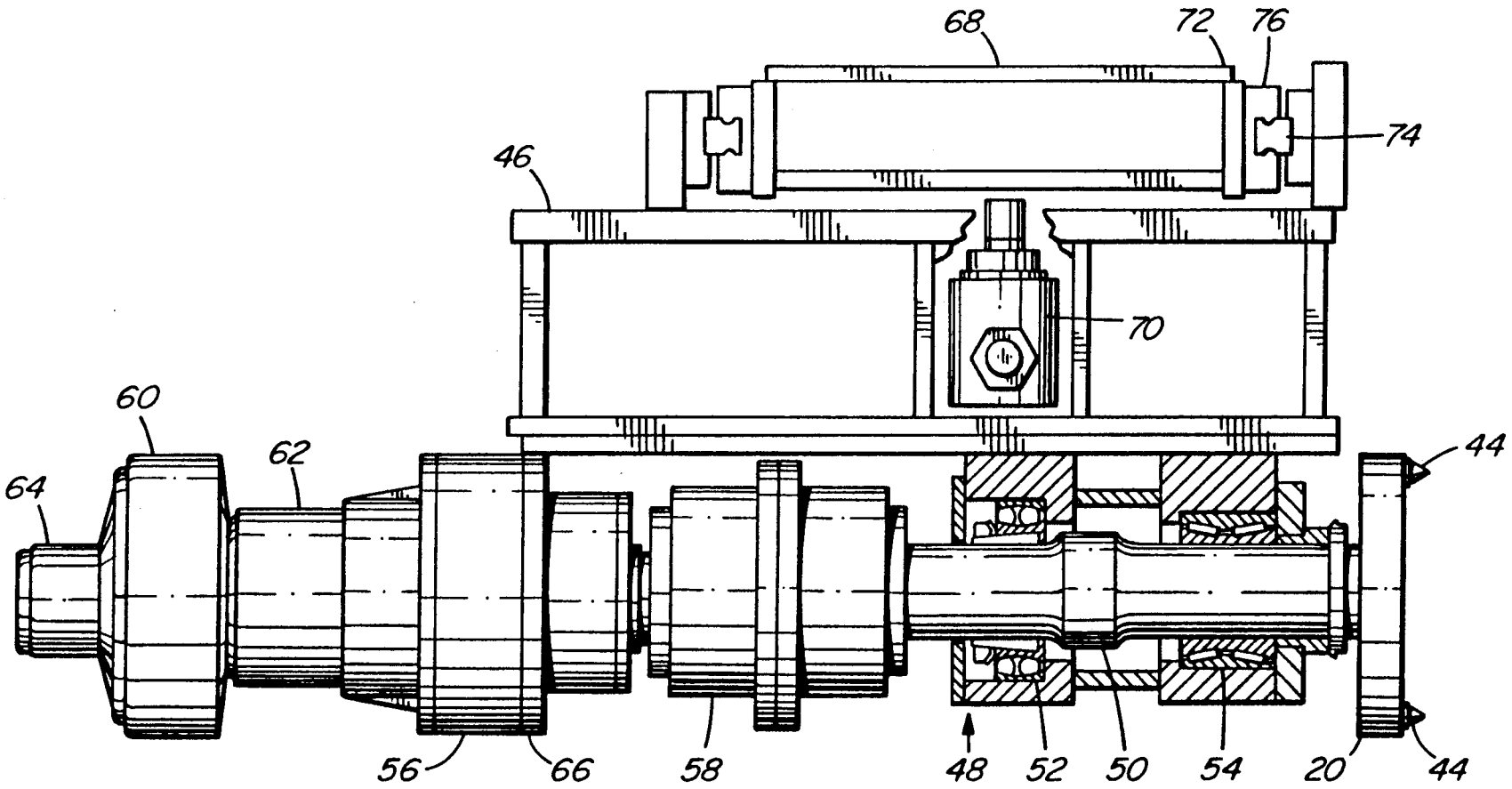
FIG. 4 is an enlarged plan view, partly in section, of the drive dog assembly from the carriage FIG. 1.

First end-dog member 20 comprises a disk with a plurality of pointed projections or dogs 44 thereon, as best seen in FIG. 4. The dog member is rotatably mounted on first dog mount 46 of a first dog assembly, shown generally at 48, by means of arbor 50 which is rotatably received by bearings 52 and 54. In this example bearing 52 is a spherical roller bearing and bearing 54 is a tapered roller bearing. The arbor is connected to a gear reducer 56 by a coupling 58. The gear reducer is connected to an hydraulic motor 60 equipped with a brake 62, which includes a speed sensor, and an encoder 64 for indicating the rotational position of the motor. A REXROTH (T.M.) MR 190N radial piston hydraulic motor is used in this example, though other motors could be substituted. The gear reducer, motor and related equipment are mounted on a mount 66 connected to first dog mount 46.

Dog assembly 48 includes a box-like frame 68, best seen in FIG. 1 and 2. As best seen in FIG. 2, first dog mount 46 is connected to a vertically oriented hydraulic cylinder 70 capable of moving the first dog mount vertically along guide assembly 72 best seen in FIG. 4. The assembly includes opposing guide rails 74 on mount 46 and corresponding channels 76 on frame 68.

In this example cylinder 70 is a hydraulic cylinder fitted with a Temposonic (T.M.) transducer. Such sonic transducers allow the controls for the carriage to accurately set the position of the cylinders. Other actuators could be substituted.

Referring to FIG. 2, frame 68 is connected to a horizontal cylinder 78 similar to cylinder 70. The frame has two pairs of shoes 80 and 82 which slidingly engage a pair of spaced-apart guide tracks 84, only one of which is seen in FIG. 1 and 2. Cylinder 78 is capable of moving dog member 20 in a horizontal direction, generally perpendicular to the longitudinal axis of log 24.

Figure 5:
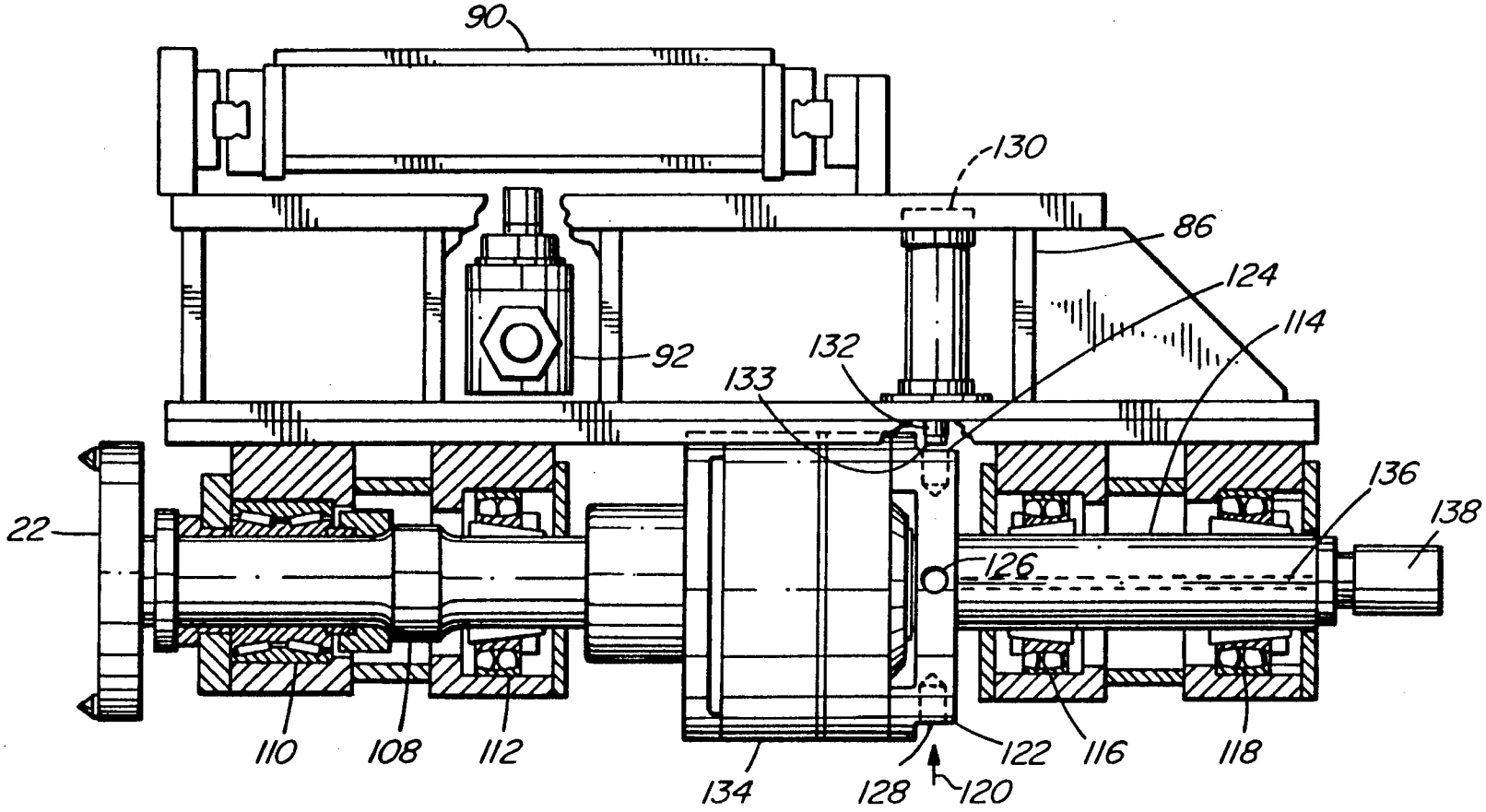
FIG. 5 is an enlarged plan view, partly in section, of the clutch dog assembly from the carriage of FIG. 1.

Dog member 22 is substantially the same as dog member 20 and is mounted rotatably on a second dog mount 86 of a second dog assembly 88 as shown in FIG. 1 and 5. It has a frame 90 similar to frame 68. The general arrangement is similar to the first dog assembly including a cylinder 92 which is equivalent to cylinder 70 and moves mount 86 vertically with respect to frame 90. There is a cylinder 94, shown only in FIG. 1, which is equivalent to cylinder 78 of the first dog assembly, for moving frame 90, and consequently dog member 22, horizontally and generally perpendicular to the longitudinal axis of log 24.

The carriage also has means for moving dog members 20 and 22 towards or away from each other. Guide rails 84 of the first dog assembly are mounted on a frame 98 shown in FIG. 2. The frame has a guide 100 and a cylinder 102, shown best in FIG. 1, for moving the first dog assembly, and consequently dog member 20, in a direction parallel to the longitudinal axis of the log, to move dog members 20 and 22 toward each other or away from each other. Guide 100 includes a pair of spaced-apart members 103 having recesses 104 therein for slidably receiving rails 106 mounted on platform portion 28 of carriage frame 12.

Referring back to FIG. 5, dog member 22 is connected to arbor 108 which is rotatable about bearings 110 and 112 on second dog mount 86. There is a second arbor 114 rotatably mounted on dog mount 86 coaxially with arbor 108, by means of bearings 116 and 118 which are similar to bearings 52 and 54. An indexing device 120 includes a disk 122 on the end of arbor 114 closest to dog member 22. There is a plurality of apertures extending radially inwards from the outer periphery of disk 122, three such apertures 124, 126 and 128 being shown in FIG. 5. These three apertures are angularly spaced-apart by ninety degrees from each other in this example. A fourth such aperture diametrically opposite aperture 126 can not be seen.

The indexing device also includes an hydraulic cylinder 130 connected to mount 86. The cylinder has a pin 132 with a tapered end 133. The pin can be extended from the cylinder to enter one of the apertures 124, 126 or 128 by supplying hydraulic fluid to the cylinder. The pin tightly fits within the aperture to keep disk 122 and arbor 114 from turning when the pin engages one of the apertures.

A clutch 134 is positioned between arbor 108 and arbor 114. In this example, an Eaton Airflex (T.M.) clutch, model No. CH 1050 is used, though alternative clutchs could be employed. One side of the clutch is connected to arbor 108 and the other side to arbor 114. Consequently, when the clutch is engaged, arbor 108 and dog member 22 are operatively connected to arbor 114 and indexing device 120. When the clutch is disengaged, dog member 22 is disconnected from the indexing device. Arbor 114 has a central, longitudinal aperture 136 which extends between the clutch and an hydraulic rotary union 138 to supply hydraulic fluid for actuation of the clutch.

OPERATION

Referring to FIG. 1 and 2, before log 24 is loaded onto the end-dogging log carriage 10, end-dog members 20 and 22 are separated using cylinder 102 connected to the first dog assembly 48. The carriage is moved to a position along the guide tracks 16 and 18 out of the way of band saw 26. Log 24 may be delivered to the carriage by a charger or loaded onto the carriage by a log stop unloader, neither forming part of the invention. The latter equipment is well known and each of the dog assemblies 48 and 88 is provided with an area which can support each end of the log. Each assembly has two rolls below its dog member to initially support the log. The rolls are each rotatable about an axis perpendicular to the longitudinal axis of the log. The outer ends of the rolls can be tilted up to form a V-shaped configuration which cradles the log and centers it. The dog members can then be positioned to dog the log at its ends. After this is done, the rolls are returned to their original position so the log is solely supported by the dog members.

Once the log has been dogged, the dog members are aligned with each other and the longitudinal axis of the log. With clutch 134 disengaged, the log can be rotated by motor 60. The log can be scanned at this time with, for example, a surface scan using lasers or X-ray scanned for knots, defects or rot within the log. The rotational speed of motor 60 can be adjusted so that the surface velocity of each log is adjusted to a constant speed for the scanning process. The scanning process can be performed, for example, by moving the scan back and forth along the log as it rotates. The carriage 10 need not be used in conjuction with such a scanning process, but it is well adapted for this.

Once the scanning process, if any, is completed, the carriage can then perform the function of orienting the log so that it is properly sawn by band saw 26 shown in FIG. 1. The data obtained from a scanning process can be utilized to properly orient the log for the initial sawing position as illustrated. The log need never be removed from the position between the dogs after being loaded and until the sawing process is complete. Therefore, once the profile of the log is ascertained by a scanning process, it can be oriented to the required rotational position as determined by encoder 64.

When the log has been positioned for the initial sawing as shown in FIG. 1, cylinder 130 is used to extend pin 132 to engage one of the apertures in disk 122, such as aperture 124 at the top thereof illustrated in FIG. 5. Clutch 134 then engages arbor 114 to arbor 108 so the rotational position of the log is firmly fixed.

Figure 3:
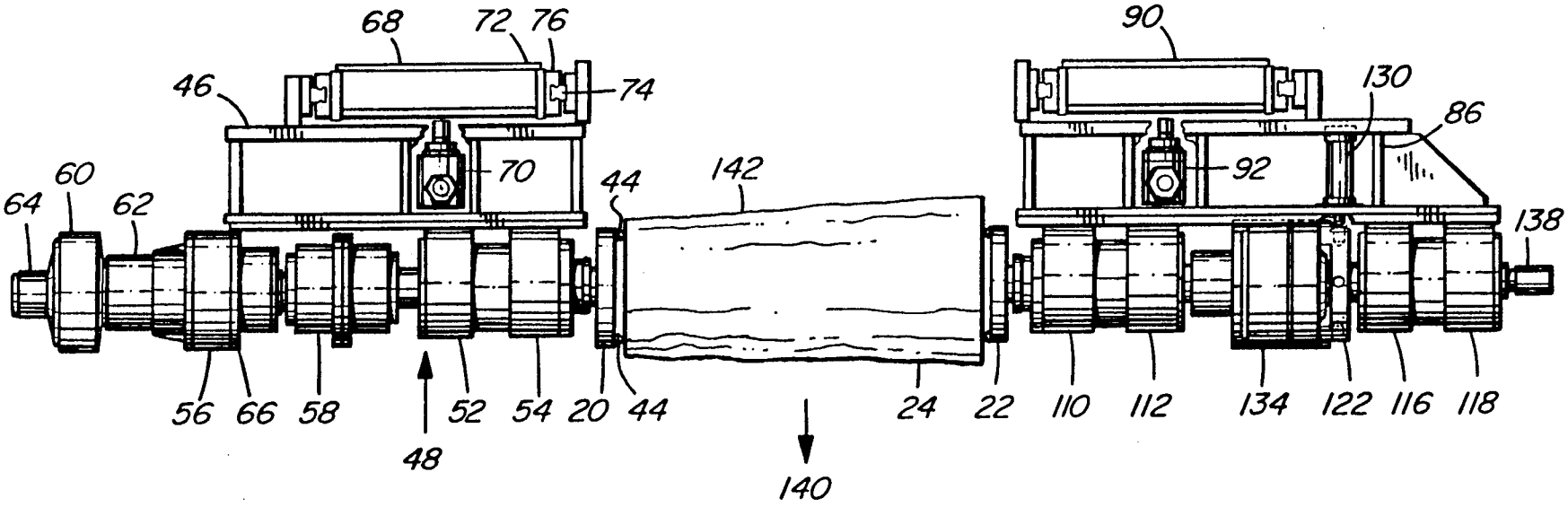
FIG. 3 is a top plan view of a portion of the carriage of FIG. 1, partly in section, with a log secured between the end-dogs thereof.

It is also necessary to tilt the log, perpendicular to its longitudinal axis to maximize the yield from the sawing operations. For example, referring to FIG. 3, the initial cut normally should be made parallel to the outer surface of the log to maximize the length of boards cut from the more valuable outside wood. The log therefore should be tilted in the direction indicated by arrow 140 so that the outer surface 142 is generally parallel to the saw blade. This tilting can be effected employing the horizontial cylinders 78 and 94 on the end-dog assemblies 48 and 88 respectively. Vertical movement of the log is accomplished using cylinders 70 and 92 to move the dog members. This can raise the log from the initial loading position until it is aligned with dog members 20 and 22 which can then engage its ends. This description relates to a carriage used for a vertical saw. The saw could be horizontal or at some other angle. The same carriage 10 can be used but the functions of the cylinders are altered.

Once the first cut shown in FIG. 1 is completed, the log is moved toward the saw blade by moving cylinders 78 and 94 slightly more than the thickness of the board being cut. This procedure is repeated until the desired amount of wood is removed from side 142 or until the saw blade approaches the end-dog members.

Depending upon the characteristics of the log and the desired type of sawing, the log usually must be turned ninety degrees or one hundred and eighty degrees for the next saw cut. The log is rotated by retracting pin 132 of cylinder 130 and then using motor 60 to rotate the log the required number of degrees as determined by encoder 64. Clutch 134 is left engaged. Once the log has been rotated approximately the correct amount, pin 132 is extended. Its tapered outer end 133 allows it to enter one of the other apertures, such as aperture 126 or 128, even though not initially aligned exactly. Once the pin enters the approprate aperture, the log is rotated exactly the right amount, usually ninety degrees or one hundred and eighty degrees, for the next cut. It is important that this angle of rotation be exact in order to maximize yield and for uniform board thickness. Even a very small angle of error in the rotation can have a significant and detrimental effect on the uniformity of the boards sawn. The use of indexing device 120 ensures that the rotation is exact.

When the log has been rotated the required amount, it can be tilted again as required, for example, so that the side of the log facing the saw blade is generally parallel to the blade. This is done by moving the end-dog members with cylinders 78 and/or 94.

It will be understood by someone skilled in the art that many of the details given above are by way of example only and can be altered without departing from the scope of the invention which is to be determined with reference to the following claims.

What is claimed is:

1. An end-dogging log carriage, comprising:

a carriage frame;

a first dog assembly mounted on the carriage frame and having a first dog support and a first log end engaging dog member rotatably mounted on the first dog support;

a second dog assembly mounted on the carriage frame, the second dog assembly having a second dog support and a second log end engaging dog member rotatably mounted on the second dog support, the second dog member generally facing the first dog member and being spaced-apart therefrom;

a motor operatively connected to one of the dog members for rotating said dog members and logs held between the dog members;

an indexing device including a rotatable member and a latching device which is releasably engagable with the rotatable member at one of a plurality of preset positions; and a clutch which releasably and operatively engages the indexing device to one of the dog members, whereby the dog members and logs held between the dog members are non-rotatable when the clutch and the latching device are engaged, the dog members and logs held between the dog members being rotatable when the clutch is released, and the dog members and logs held between the dog members being selectively rotatable to a plurality of fixed angular positions when the clutch is engaged and the latching device engages the rotatable member at different said preset positions.

2. A carriage as claimed in claim 1, wherein the second dog member is on a second dog arbor rotatably mounted on the second dog support, the clutch being connected to an end of the arbor opposite the second dog member.

3. A carriage as claimed in claim 2, wherein the indexing device is connected to the clutch on a side thereof opposite said second dog arbor, the indexing device including a rotatable disk operatively connected to the clutch and having recesses therein, the latching device being selectively receivable in any of said recesses.

4. A carriage as claimed in claim 3, wherein the recesses are sockets extending radially inwards from the periphery of the disk, the latching device including a pin extending towards the periphery of the disk in a radial direction.

5. A carriage as claimed in claim 4, wherein the indexing device further includes an hydraulic actuator operatively connected to the pin for moving the pin into a selected socket or retracting the pin from the sockets.

6. A carriage as claimed in claim 5, wherein the pin has a tapered end.

7. In combination:

a log;

a saw having a blade;

a guide track near the saw running parallel to the saw blade; and an end-dogging log carriage movably mounted on the guide track for movement therealong, the carriage including a carriage frame, a first dog assembly mounted on the frame having a first dog support and a first log end engaging dog member rotatably mounted on the first dog support, and a second dog assembly mounted on the frame having a second dog support and a second log end engaging dog member rotatably mounted on the second dog support, the log being between the dog members and being solely supported by the first and second dog members engaging opposite ends of the log, the carriage including means for moving at least one said dog member with respect to the carriage frame to orient the log to a desired position for sawing the log when the carriage moves along the guide track.

8. A combination as claimed in claim 7, wherein the log carriage includes means for selectively holding the dog members and the log at fixed rotational positions about the longitudinal axis of the log during sawing of the log.

9. A combination as claimed in claim 7, wherein one said dog member is movable in a direction generally perpendiclar to the longitudinal axis of the log.

10. A combination as claimed in claim 7, wherein one said one dog member is also movable horizontally in a direction generally parallel to the longitudinal axis of the log.

11. A combination as claimed in claim 7, including means for moving both said dog members horizontally, and perpendicular to the longitudinal axis of the log, and vertically.

12. A combination as claimed in claim 11, further including means for moving the dog members toward each other or away from each other.

13. A combination as claimed in claim 7, further including a motor operatively connected to one of the dog members for rotating the dog members and the log about the longitudinal axis of the log.

14. A combination as claimed in claim 13, further including means for selectively holding the dog members and the log at fixed angular positions about the longitudinal axis of the log.

15. A combination as claimed in claim 13, further including means for sensing the rotational position of the dog members and the log.

16. An end-dogging log carriage for supporting a log by the ends of the log only and moving the log generally along the longitudinal axis of the log past a saw blade to saw the log, the carriage comprising;

a carriage frame having guide members thereon for guiding movement of the carriage parallel to said axis;

a first dog assembly mounted on the frame and having a first dog support with a first dog member rotatably mounted thereon, a motor operatively connected to the first dog member for rotating the first dog member, a first guide and a first actuator operatively connected to the first dog member support and capable of moving the first dog member horizontally and perpendicular to said axis, and a second guide and a second actuator operatively connected to the first dog support and capable of moving the first dog member vertically;

a second dog assembly mounted on the frame and having a second dog support with a second dog member rotatably mounted thereon and facing the first dog member, an indexing device selectively engagable in any of a plurality of rotational positions, a clutch operatively connecting the indexing device to the second dog member when engaged, a third actuator and a third guide operatively connected to the second dog support and capable of moving the second dog member horizontally and perpendicular to said axis, and a fourth actuator and a fourth guide operatively connected to the second dog support and capable of moving the second dog member vertically; and a fifth actuator and a fifth guide operatively connected to one of the dog assemblies and capable of moving the dog members closer together or further apart.

17. A carriage as claimed in claim 16, wherein each of the dog members includes a plurality of dogs.

18. A carriage as claimed in claim 17, wherein the dogs are connected to a disk and are spaced-apart about a circle.

19. A method of handling a log for scanning and sawing thereof, comprising:

dogging the ends of the log with opposing end-dog members;

removing any intermediate supports between the ends of the log;

aligning the dog members with the longitudinal axis of the log;

rotating the log;

moving at least one of the dog members perpendicular to the axis to orient the log in a desired cutting orientation;

connecting one of the dog members to an indexing device;

engaging the indexing device in a first position so the log is held non-rotatably between the dog members at a first angular position about its axis;

sawing the log;

engaging the indexing device in a second position so the log is held non-rotatably between the dog members at a second angular position about its axis; and sawing the log again.

* * * * *